US010501892B2

(12) United States Patent
Shannon et al.

(10) Patent No.: US 10,501,892 B2
(45) Date of Patent: Dec. 10, 2019

(54) SOFT TISSUE COMPRISING SYNTHETIC FIBERS

(71) Applicant: Kimberly-Clark Worldwide, Inc., Neenah, WI (US)

(72) Inventors: Thomas Gerard Shannon, Neenah, WI (US); Bo Shi, Neenah, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 16/094,593

(22) PCT Filed: Sep. 29, 2016

(86) PCT No.: PCT/US2016/054420
§ 371 (c)(1),
(2) Date: Oct. 18, 2018

(87) PCT Pub. No.: WO2018/063240
PCT Pub. Date: Apr. 5, 2018

(65) Prior Publication Data

US 2019/0161916 A1 May 30, 2019

(51) Int. Cl.

| | |
|---|---|
| ***D21H 27/00*** | (2006.01) |
| ***D21H 27/34*** | (2006.01) |
| ***D21H 13/02*** | (2006.01) |
| ***D21H 15/06*** | (2006.01) |
| ***D21H 15/10*** | (2006.01) |

(52) U.S. Cl.
CPC ..... *D21H 27/005* (2013.01); *D21H 13/02* (2013.01); *D21H 15/06* (2013.01); *D21H 27/34* (2013.01); *D21H 15/10* (2013.01)

(58) Field of Classification Search
CPC .... D21H 27/005; D21H 27/002; D21H 27/30; D21H 27/38; D21H 13/24; D21H 15/10; D21H 13/02; D21H 13/14; D21H 13/18; D21H 13/26; D21H 15/06; D21H 21/18; D21H 27/007; D21H 27/34; A47K 10/16; Y10T 428/24612; Y10T 442/641
See application file for complete search history.

(56) References Cited

U.S. PATENT DOCUMENTS

| | | | | |
|---|---|---|---|---|
| 3,047,455 | A | | 7/1962 | Anderson |
| 3,057,772 | A | * | 10/1962 | Magill, Jr. ..... D21H 13/26 162/146 |
| 3,905,863 | A | | 9/1975 | Ayers |
| 4,007,083 | A | * | 2/1977 | Ring ..... D21F 11/002 162/101 |
| 4,565,727 | A | | 1/1986 | Giglia |
| 4,755,421 | A | | 7/1988 | Manning |
| 4,902,564 | A | | 2/1990 | Israel |
| 4,904,343 | A | | 2/1990 | Giglia |
| 5,049,235 | A | | 9/1991 | Barcus |
| 5,122,407 | A | | 6/1992 | Yeo |
| 5,320,710 | A | | 6/1994 | Reeves |
| 5,529,665 | A | | 6/1996 | Kaun |
| 5,679,218 | A | | 10/1997 | Vinson |
| 5,785,813 | A | | 7/1998 | Smith |
| 5,935,880 | A | | 8/1999 | Wang |
| 6,187,137 | B1 | | 2/2001 | Druecke |
| 6,197,154 | B1 | | 3/2001 | Chen |
| 6,277,241 | B1 | | 8/2001 | Merker |
| 6,727,004 | B2 | | 4/2004 | Goulet |
| 6,861,380 | B2 | | 3/2005 | Garnier |
| 7,449,085 | B2 | | 11/2008 | Hermans |
| 7,718,036 | B2 | | 5/2010 | Sumnicht |
| 7,749,356 | B2 | | 7/2010 | Runge |
| 7,867,362 | B2 | | 1/2011 | Allen |
| 7,935,221 | B2 | | 5/2011 | Allen |
| 7,972,986 | B2 | | 7/2011 | Barnholtz |
| 8,057,636 | B2 | | 11/2011 | Vinson |
| 8,133,353 | B2 | | 3/2012 | Blanz |
| 8,187,421 | B2 | | 5/2012 | Sumnicht |
| 8,216,424 | B2 | | 7/2012 | Bhat |
| 8,225,729 | B2 | | 7/2012 | MacDonald |

(Continued)

FOREIGN PATENT DOCUMENTS

| | | | |
|---|---|---|---|
| EP | 0851062 | A2 | 7/1998 |
| WO | WO13116066 | A1 | 8/2013 |

(Continued)

OTHER PUBLICATIONS

CFF® Fibrillated Fiber, available at Internet web page "https://web.archive.org/web/20160608223654/http://eftfibers.com/doc/d3.pdf", Jun. 6, 2016, 5 pages.

*Primary Examiner* — Jose A Fortuna

(74) *Attorney, Agent, or Firm* — Kimberly-Clark Worldwide, Inc.

(57) ABSTRACT

The present invention provides a tissue product formed from a fiber furnish consisting essentially of short cellulosic fibers, such as fibers having an average fiber length less than about 2.0 mm, and a synthetic fiber having at least one cross-section dimension less than about 20 microns. The invention also provides a tissue product comprising at least one wet laid multi-layered tissue web comprising a fiber furnish consisting essentially of synthetic fibers and short cellulosic fibers, the multi-layered tissue web having a first and second outer layer and a middle layer disposed there between where the synthetic fibers are selectively disposed in the middle layer. Generally the tissue product comprises less than about 30 percent, by weight of the tissue product, synthetic fiber. In a preferred embodiment the tissue product comprises non-fibrillated polyethylene terephthalate (PET) fibers having a circular cross-section shape with a diameter less than about 5.0 microns and are substantially free from long cellulosic fibers. Despite being free from long cellulosic fibers the tissue product have good strength and low stiffness.

17 Claims, No Drawings

(56) References Cited

U.S. PATENT DOCUMENTS 8,444,811 B2 5/2013 Dyer
8,513,147 B2 8/2013 Gupta
8,673,116 B2 3/2014 Konishi
8,702,905 B1 * 4/2014 Hermans ..... D21H 27/005 162/109
8,753,751 B1 6/2014 Hermans
8,778,505 B2 7/2014 Shannon
8,864,945 B2 10/2014 Miller
9,005,738 B2 4/2015 Baker et al.
9,074,324 B2 7/2015 Shannon
9,267,240 B2 2/2016 Lee
9,282,870 B2 3/2016 Sumnicht
9,314,142 B2 4/2016 Baker et al.
9,661,974 B2 5/2017 Baker et al.
10,045,677 B2 8/2018 Baker et al.
10,301,779 B2 5/2019 Sealey, II et al.
10,422,083 B2 * 9/2019 Baum ..... D21H 27/02
2002/0162635 A1 11/2002 Hsu
2003/0098135 A1 5/2003 Ross
2004/0087237 A1 * 5/2004 Garnier ..... D21H 27/38 442/413
2004/0154763 A1 8/2004 Polat
2005/0045293 A1 3/2005 Hermans
2005/0241786 A1 11/2005 Edwards
2006/0289134 A1 12/2006 Yeh
2007/0137808 A1 * 6/2007 Lostocco ..... A47K 10/16 162/109
2007/0144697 A1 * 6/2007 Dyer ..... D21H 21/146 162/158
2007/0187055 A1 8/2007 Manifold et al.
2007/0232178 A1 10/2007 Polat
2007/0232180 A1 10/2007 Polat
2007/0254550 A1 11/2007 Hamed
2007/0284069 A1 12/2007 Dyer
2008/0014428 A1 1/2008 Vinson et al.
2009/0022983 A1 1/2009 Cabell
2009/0036015 A1 2/2009 Nhan
2011/0104493 A1 5/2011 Barnholtz
2011/0220310 A1 9/2011 Polat
2012/0021178 A1 1/2012 Miller
2012/0302119 A1 11/2012 Clark
2013/0029105 A1 1/2013 Miller
2013/0071655 A1 3/2013 Zwick et al.
2013/0199741 A1 * 8/2013 Stage ..... D21H 1/00 162/100
2013/0216789 A1 8/2013 Kraus
2013/0288556 A1 10/2013 Moore
2014/0096924 A1 4/2014 Rekoske et al.
2014/0311694 A1 10/2014 Clark
2014/0311695 A1 10/2014 Clark
2015/0114580 A1 4/2015 McKee
2015/0240426 A1 * 8/2015 Hermans ..... D21H 27/005 162/109
2015/0330029 A1 11/2015 Ramaratnam et al.
2016/0145809 A1 5/2016 Hermans et al.
2016/0145810 A1 5/2016 Miller, IV
2017/0070036 A1 3/2017 Derouen
2017/0314207 A1 11/2017 Sealey, II et al.
2017/0370036 A1 * 12/2017 Hermans ..... D04H 1/425
2018/0142419 A1 5/2018 Rouse et al.
2018/0142422 A1 * 5/2018 Baum ..... D21H 27/02
2018/0334778 A1 * 11/2018 Shannon ..... D21F 11/14
2018/0344120 A1 12/2018 Baker et al.
2019/0161916 A1 * 5/2019 Shannon ..... D21H 27/005
2019/0169798 A1 6/2019 Rouse et al.

FOREIGN PATENT DOCUMENTS

WO WO16122477 A1 8/2016
WO WO16134256 A1 8/2016
WO 18156111 A1 8/2018
WO WO-2018156111 A1 * 8/2018 ..... D21F 11/14

* cited by examiner

SOFT TISSUE COMPRISING SYNTHETIC FIBERS

BACKGROUND OF THE DISCLOSURE

Papermakers, and particular tissue paper makers, have long sought to balance the strength and softness of paper products by treating or altering the papermaking furnish. For example, one common practice in the manufacture of tissue products is to provide two furnishes (or sources) of wood pulp fiber. Sometimes, a two-furnish system is used in which the first furnish comprises a wood pulp fiber having a relatively short fiber length, such as a hardwood kraft pulp fiber, and the second furnish is made of wood pulp fiber having a relatively long fiber length, such as softwood kraft pulp fiber. The short fiber furnish may be used to provide the finished product with a softer handfeel, while the long fiber furnish may be used to provide the finished product with strength.

While surface softness in tissue products is an important attribute; a second element in the overall softness is stiffness. Stiffness can be measured from the tensile slope of stress-strain tensile curve. The lower the slope the lower the stiffness and the better overall softness the product will display. Stiffness and tensile strength are positively correlated, however at a given tensile strength shorter fibers will display a greater stiffness than long fibers. While not wishing to be bound by theory, it is believed that this behavior is due to the higher number of hydrogen bonds required to produce a product of a given tensile strength with short fibers than with long fibers. Thus, easily collapsible, low coarseness long fibers, such as those provided by Northern Softwood Kraft (NSWK) fibers typically supply the best combination of durability and softness in tissue products when those fibers are used in combination with hardwood Kraft fibers such as Eucalyptus hardwood Kraft fibers. While Northern Softwood Kraft Fibers have a higher coarseness than Eucalyptus fibers their small cell wall thickness relative to lumen diameter combined with their long length makes them the ideal candidate for optimizing durability and softness in tissue.

Unfortunately, supply of NSWK is under significant pressure both economically and environmentally. As such, prices of NSWK fibers have escalated significantly creating a need to find alternatives to optimize softness and strength in tissue products. Another type of softwood fiber is Southern Softwood Kraft (SSWK) widely used in fluff pulp containing absorbent products such as diapers, feminine care absorbent products and incontinence products. Unfortunately while not under the same supply and environmental pressures as NSWK, fibers from SSWK are too coarse for tissue products and are unsuitable for making soft tissue products. While having long fiber length, the SSWK fibers have too wide a cell wall width and too narrow a lumen diameter and thus create stiffer, harsher feeling products than NSWK.

The tissue maker who is able to identify fibers having a desirable combination of fiber length and coarseness from fiber blends generally regarded as inferior with respect to average fiber properties may reap significant cost savings and/or product improvements. For example, the tissue maker may wish to make a tissue paper of superior strength without incurring the usual degradation in softness which accompanies higher strength. Alternatively, the papermaker may wish a higher degree of paper surface bonding to reduce the release of free fibers without suffering the usual decrease in softness which accompanies greater bonding of surface fibers. As such, a need currently exists for a tissue product formed from a fiber that will improve durability without negatively affecting other important product properties, such as softness.

SUMMARY OF THE DISCLOSURE

It has now been surprisingly discovered that the long fiber fraction of the tissue furnish may be substituted, in some instances entirely, with synthetic fiber without negatively affecting important tissue properties such as strength and stiffness. In some instances tissue product properties may actually be improved by substituting the long fiber fraction with synthetic fiber. For example, the present invention provides a through-air dried tissue product comprising synthetic fiber having a geometric mean tensile (GMT) from about 800 to about 1200 g/3", a sheet bulk greater than about 12.0 cc/g and a Stiffness Index less than about 6.50. Surprisingly, the foregoing properties are comparable or better than those observed in through-air dried tissue products prepared entirely from wood pulp fibers, including blends of short and long fiber wood pulp fibers.

Accordingly, in certain embodiments, the present invention provides tissue products comprising synthetic fibers and substantially free of wood kraft pulp fibers having an average fiber length greater than about 2.0 mm where the tissue products have a lower geometric mean slope (GM Slope) at a given GMT compared to comparable tissue products prepared without synthetic fibers and containing wood kraft pulp fibers having an average fiber length greater than about 2.0 mm. As such, the inventive tissue products generally have low stiffness at a given tensile strength without resorting to the use of wood kraft pulp fibers having an average fiber length greater than about 2.0 mm.

In other embodiments the present disclosure provides a tissue product comprising at least one tissue web, the tissue web comprising synthetic fibers having an average fiber length less than 5.0 mm and at least one cross-section dimension less than about 20 microns, the tissue product having a GMT greater than about 800 g/3" and a basis weight greater than about 30 grams per square meter (gsm), more preferably greater than about 34 gsm and still more preferably greater than about 36 gsm, such as from about 30 to about 50 gsm.

In yet other embodiments the present invention provides a tissue product comprising at least one through-air dried tissue web, the tissue web comprising synthetic fibers having an average fiber length less than 5.0 mm and at least one cross-section dimension less than about 20 microns, the product having a GMT from about 800 to about 1500 g/3" and a GM Slope from about 5.0 to about 10.0 kg.

In other embodiments the present invention provides a tissue product comprising at least two conventional wet pressed, creped tissue webs, the webs comprising a first and second outer layer and a middle layer disposed there between, and a fiber furnish consisting essentially of synthetic fibers and short cellulosic fibers, where the synthetic fibers are selectively disposed in the middle layer and the first and second layers are substantially free from synthetic fibers, the tissue product having a geometric mean tensile (GMT) greater than about 800 g/3" and a geometric mean slope (GM Slope) less than about 15.0 kg.

In still other embodiments the present invention provides a tissue product comprising at least one through-air dried tissue web, the tissue web comprising synthetic fibers having an average fiber length less than 5.0 mm and at least one cross-section dimension less than about 20 microns, the product having an Absorbent Capacity greater than about 6.0 g/g and a CD Wet/Dry Ratio greater than about 0.40, wherein the product is substantially free of latex binder.

In other embodiments the present disclosure provides an uncreped through-air dried tissue product comprising at least one through-air dried tissue web, the tissue web comprising synthetic fibers having an average fiber length less than 5.0 mm and at least one cross-section dimension less than about 20 microns, the tissue product having a GMT from about 1500 to about 3000, a CD Wet/Dry Ratio greater than about 0.40 and a CD Wet Tensile greater than about 400 g/3".

In still other embodiments the present disclosure provides a through-air dried tissue product comprising from about 10 to about 30 percent, by weight of the product, synthetic fibers, the tissue product having an Absorbent Capacity greater than about 6.0 g/g and a CD Wet/Dry Ratio greater than about 0.40.

In yet other embodiments the present disclosure provides a layered through-air dried tissue product comprising at least one tissue web comprising a first fibrous layer and a second fibrous layer, the first fibrous layer comprising wood pulp fibers and the second fibrous layer comprising synthetic fibers, wherein the first fibrous layer is substantially free of synthetic fibers and wherein the synthetic fibers comprise less than about 10 percent of the total weight of the through-air dried web, the tissue product having a GMT greater than about 800 g/3", a basis weight greater than about 30 gsm and a Stiffness Index less than about 8.0.

DEFINITIONS

As used herein, the term "Average Fiber Length" refers to the length weighted average fiber length of fibers determined utilizing a Kajaani fiber analyzer model No. FS-100 available from Kajaani Oy Electronics, Kajaani, Finland. According to the test procedure, a pulp sample is treated with a macerating liquid to ensure that no fiber bundles or shives are present. Each pulp sample is disintegrated into hot water and diluted to an approximately 0.001 percent solution. Individual test samples are drawn in approximately 50 to 100 ml portions from the dilute solution when tested using the standard Kajaani fiber analysis test procedure. The weighted average fiber length may be expressed by the following equation:

$$\sum_{x_i=0}^{k} (x_i \times n_i)/n$$

where k=maximum fiber length
$x_i$=fiber length
$n_i$=number of fibers having length $x_i$
n=total number of fibers measured.

As used herein the term "Fiber" means an elongate particulate having an apparent length greatly exceeding its apparent width. More specifically, and as used herein, fiber refers to such fibers suitable for a papermaking process and more particularly the tissue paper making process.

As used herein the term "Synthetic Fiber" refers to a water dispersible, non-cellulosic, thermoplastic fiber.

As used herein the term "Thermoplastic" means a plastic which becomes pliable or moldable above a specific temperature and returns to a solid state upon cooling. Exemplary thermoplastic fibers suitable for the present embodiments include polyesters (e.g., polyalkylene terephthalates such as polyethylene terephthalate (PET), polybutylene terephthalate (PBT) and the like), polyalkylenes (e.g., polyethylenes, polypropylenes and the like), poyacrylonitriles (PAN), and polyamides (nylons, for example, nylon-6, nylon 6,6, nylon-6,12, and the like). Preferred are PET fibers.

As used herein the term "Cellulosic Fiber" refers to a fiber composed of or derived from cellulose.

As used herein, the term "Long Cellulosic Fiber" refers to a cellulosic fiber having an average fiber length of at least about 2.0 mm. These long papermaking fibers are typically softwood fibers such as, for example, Northern Softwood Kraft (NSWK) fibers or Southern Softwood Kraft (SSWK) fibers.

As used herein, the term "Short Cellulosic Fiber" refers to a cellulosic fiber having an average fiber length less than about 2.0 mm, such as from about 0.5 to about 2.0 mm and more preferably from about 0.75 to about 1.5 mm. These short papermaking fibers are typically hardwood fibers such as, for example, Eucalyptus Hardwood Kraft (EHWK) fibers.

As used herein, the term "Tissue Product" refers to products made from tissue webs and includes, bath tissues, facial tissues, paper towels, industrial wipers, foodservice wipers, napkins, medical pads, and other similar products.

As used herein, the terms "Tissue Web" and "Tissue Sheet" refer to a fibrous sheet material suitable for use as a tissue product.

As used herein, the term "Ply" refers to a discrete product element. Individual plies may be arranged in juxtaposition to each other. The term may refer to a plurality of web-like components such as in a multi-ply facial tissue, bath tissue, paper towel, wipe, or napkin.

As used herein, the term "Layer" refers to a plurality of strata of fibers, chemical treatments, or the like, within a ply.

As used herein, the terms "Layered Tissue Web" and the like generally refer to sheets of paper prepared from two or more layers of aqueous papermaking furnish which are preferably comprised of different fiber types. The layers are preferably formed from the deposition of separate streams of dilute fiber slurries, upon one or more endless foraminous screens. If the individual layers are initially formed on separate foraminous screens, the layers are subsequently combined (while wet) to form a layered composite web.

As used herein the term "Basis Weight" generally refers to the bone dry weight per unit area of a tissue and is generally expressed as grams per square meter (gsm). Basis weight is measured using TAPPI test method T-220. While basis weight may be varied, tissue products prepared according to the present invention and comprising one, two or three plies, generally have a basis weight greater than about 30 gsm, such as from about 30 to about 60 gsm and more preferably from about 35 to about 45 gsm.

As used herein the term "Caliper" is the representative thickness of a single sheet (caliper of tissue products comprising two or more plies is the thickness of a single sheet of tissue product comprising all plies) measured in accordance with TAPPI test method T402 using an EMVECO 200-A Microgage automated micrometer (EMVECO, Inc., Newberg, Oreg.). The micrometer has an anvil diameter of 2.22 inches (56.4 mm) and an anvil pressure of 132 grams per square inch (per 6.45 square centimeters) (2.0 kPa). The caliper of a tissue product may vary depending on a variety of manufacturing processes and the number of plies in the product, however, tissue products prepared according to the present invention generally have a caliper greater than about 500 μm, more preferably greater than about 575 μm and still more preferably greater than about 600 μm, such as from about 500 to about 800 μm and more preferably from about 600 to about 750 μm.

As used herein the term "Sheet Bulk" refers to the quotient of the caliper (generally having units of μm) divided by the bone dry basis weight (generally having units of gsm). The resulting sheet bulk is expressed in cubic centimeters per gram (cc/g). Through-air dried tissue products prepared according to the present invention generally have a sheet bulk greater than about 8 cc/g, more preferably greater than about 10 cc/g and still more preferably greater than about 12 cc/g, such as from about 8 to about 20 cc/g and more preferably from about 12 to about 18 cc/g. Creped wet pressed tissue products prepared according to the present invention generally have a sheet bulk greater than about 7 cc/g, more preferably greater than about 9 cc/g, such as from about 7 to about 10 cc/g.

As used herein, the term "Geometric Mean Tensile" (GMT) refers to the square root of the product of the machine direction tensile strength and the cross-machine direction tensile strength of the tissue product. While the GMT may vary, tissue products prepared according to the present invention generally have a GMT greater than about 700 g/3", more preferably greater than about 750 g/3" and still more preferably greater than about 800 g/3", such as from about 700 to about 1200 g/3".

As used herein, the term "Slope" refers to the slope of the line resulting from plotting tensile versus stretch and is an output of the MTS TestWorks™ in the course of determining the tensile strength as described in the Test Methods section herein. Slope is reported in the units of grams (g) per unit of sample width (inches) and is measured as the gradient of the least-squares line fitted to the load-corrected strain points falling between a specimen-generated force of 70 to 157 grams (0.687 to 1.540 N) divided by the specimen width. Slopes are generally reported herein as having units of grams (g) or kilograms (kg).

As used herein, the term "Geometric Mean Slope" (GM Slope) generally refers to the square root of the product of machine direction slope and cross-machine direction slope. GM Slope generally is expressed in units of kilograms (kg). While the GM Slope may vary, tissue products prepared according to the present invention generally have a GM Slope less than about 15.0 kg, more preferably less than about 10.0 kg and still more preferably less than about 8.0 kg.

As used herein, the term "Stiffness Index" refers to GM Slope (having units of kg), divided by GMT (having units of g/3") multiplied by 1,000. While the Stiffness Index may vary, tissue products prepared according to the present invention generally have a Stiffness Index less than about 10.0, more preferably less than about 8.0 and still more preferably less than about 6.0.

As used herein, the term "geometric mean tensile energy absorption" (GM TEA) refers to the square root of the product MD TEA and CD TEA, which are measured in the course of determining tensile strength as described below. GM TEA has units of gm*cm/cm$^2$.

As used herein the term "CD Wet/Dry Ratio," refers to the ratio of the wet CD tensile strength to the dry CD tensile strength, measured as described in the Test Methods Section, below. While the CD Wet/Dry Ratio may vary, tissue products prepared as described herein generally have a CD Wet/Dry Ratio greater than about 0.40, more preferably greater than about 0.42 and still more preferably greater than about 0.44, such as from about 0.40 to about 0.50. Generally the foregoing ratios are achieved at a Wet CD Tensile greater than about 400 g/3", more preferably greater than about 425 g/3" and still more preferably greater than about 450 g/3", such as from about 400 to about 550 g/3" and still more preferably from about 425 to about 500 g/3".

As used herein, the term "Absorbent Capacity" is a measure of the amount of water absorbed by the paper towel product in the vertical orientation and is expressed as grams of water absorbed per gram of fiber (dry weight). Absorbent Capacity is measured as described in the Test Methods section and generally has units of grams per gram (g/g).

As used herein, the terms "TS7" and "TS7 value" refer to the output of the EMTEC Tissue Softness Analyzer (commercially available from Emtec Electronic GmbH, Leipzig, Germany) as described in the Test Methods section. TS7 has units of dB V2 rms, however, TS7 may be referred to herein without reference to units. In certain embodiments the invention provides through-air dried tissue products comprising synthetic fibers and substantially free from long cellulosic fibers where the products have a TS7 less than about 12.0, and more preferably less than about 10.0, such as from about 8.0 to about 12.0.

As used herein the term "Substantially Free" refers to the composition of one layer of a multi-layered web which comprises less than about 0.25 percent of the subject fiber, by weight of the layer. The foregoing amounts of fiber are generally considered negligible and do not affect the physical properties of the layer. Moreover the presence of negligible amounts of a subject fibers in a given layer generally arise from fibers disposed in an adjacent layer, and have not been purposefully disposed in a given layer. For example where a given layer of a multi-layered tissue web is said to be substantially free of wood pulp fibers, the given layer generally comprises less than about 0.25 percent wood pulp fiber, by weight of the layer.

DETAILED DESCRIPTION OF THE DISCLOSURE

The present invention provides tissue products and webs comprising synthetic fibers. Surprisingly the synthetic fiber may replace a substantial portion, or in some instances all, of the long cellulosic fiber in a conventional tissue furnish without negatively affecting important tissue properties such as strength and softness. For example, in one embodiment, the present invention provides a tissue product comprising at least one through-air dried tissue web, the tissue web comprising synthetic fibers having at least one cross-section dimension less than about 20 microns, the tissue product having a geometric mean tensile (GMT) greater than about 800 g/3" and a geometric mean slope (GM Slope) less than about 10.0 kg. In certain embodiments the foregoing tissue web comprises less than about 10 percent, by weight of the web, cellulosic fibers having an average fiber length greater than about 2.0 mm, and more preferably less than about 5 percent. In a particularly preferred embodiment the synthetic fiber replaces all of the long fiber fraction in the tissue making furnish such that the tissue product is substantially free from cellulosic fibers having an average fiber length greater than about 2.0 mm.

Suitable synthetic fibers for use in the present invention include polyesters (e.g., polyalkylene terephthalates such as polyethylene terephthalate (PET), polybutylene terephthalate (FBI) and the like), polyalkylenes (e.g., polyethylenes, polypropylenes and the like), poyacrylonitriles (PAN), and polyamides (nylons, for example, nylon-6, nylon 6,6, nylon- 6,12, and the like). Preferably the synthetic fiber is non-fibrillated and more preferably the synthetic fiber is a non-fibrillated PET fiber.

Synthetic fibers useful in the present invention generally have at least one cross-section dimension less than about 20 microns, more preferably less than about 10 microns and still more preferably less than about 5.0 microns, such as from about 1.0 to about 20 microns, and more preferably from about 1.5 to about 5.0 microns. Generally the synthetic fibers have an average fiber length less than 5.0 mm, and more preferably less than about 4.0 mm and still more preferably less than about 3.5 mm, such as from about 1.0 to about 5.0 mm and more preferably from about 2.0 to about 3.5 mm.

While synthetic fibers useful in the present invention generally have at least one cross-section dimension less than about 20 microns, they may have any number of different cross-sectional shapes including, round, flat and wedge, in one particularly preferred embodiment the tissue webs and products of the present invention comprise synthetic fibers having a substantially round cross section and a diameter from about 1.0 to about 5.0 microns and more preferably from about 2.0 to about 5.0 microns. Exemplary synthetic fibers having a substantially round cross section include those commercially available under the tradename CYPHREX™ 10001 and 10002 (Eastman, Kingsport, Tenn., USA). In other embodiments the synthetic fiber may have a flat cross section where at least one of the fiber dimensions is less than about 10 microns, and more preferably less than about 5.0 microns, such as from about 1.0 to about 5.0 microns. Exemplary synthetic fibers having a flat cross section include those commercially available under the tradename CYPHREX™ 10101 (Eastman, Kingsport, Tenn., USA), Tissue webs made in accordance with the present disclosure can be made with a homogeneous fiber furnish or can be formed from a stratified fiber furnish producing layers within the single- or multi-ply product. Stratified base webs can be formed using equipment known in the art, such as a multi-layered headbox. For example, in certain embodiments, the tissue products may be prepared from multi-layered webs having a first outer layer and a second outer layer containing primarily hardwood fibers. The hardwood fibers can be mixed, if desired, with paper broke in an amount up to about 10 percent by weight and/or softwood fibers in an amount up to about 10 percent by weight. The web further includes a middle layer positioned in between the first outer layer and the second outer layer. The middle layer may contain a mixture of hardwood fibers and synthetic fibers, and more preferably a mixture of eucalyptus hardwood kraft (EHWK) fibers and synthetic fibers.

In certain embodiments the tissue products comprise from about 10 to about 30 percent, by weight of tissue web or product, synthetic fibers and more preferably from about 12 to about 25 percent, still more preferably from about 15 to about 20 percent. In particularly preferred embodiments the inventive tissue products comprise from about 10 to about 30 percent, by weight of the tissue product, synthetic fibers, but are substantially free from long cellulosic fibers. Further, it may be preferred to form the tissue product from a multi-layered web where the synthetic fiber is selectively incorporated into only a single layer of the web. For example, it may be preferred in certain embodiments to form a three layered web where the synthetic fiber is selectively incorporated in the middle layer.

While in one embodiment it is preferred that the tissue web comprise a three-layered tissue having synthetic fibers selectively incorporated into the middle layer, it should be understood that tissue products made from the foregoing multi-layered web can include any number of plies and the plies may be made from various combinations of single- and multi-layered tissue webs. Further, tissue webs prepared according to the present invention may be incorporated into tissue products that may be either single- or multi-ply, where one or more of the plies may be formed by a multi-layered tissue web having synthetic fibers selectively incorporated in one of its layers.

Surprisingly, synthetic fiber may replace all of the long fiber fraction of the tissue making furnish and still produce a tissue product having satisfactory properties. For example, the tissue product may comprise from about 10 to about 30 percent, by weight of the tissue product, synthetic fibers and be substantially free of long cellulosic fiber yet have a lower GM Slope at a given GMT compared to comparable tissue products prepared without synthetic fibers and containing long cellulosic fibers. Accordingly, in one preferred embodiment the present invention provides a wet laid tissue product formed from a fiber furnish consisting essentially of short cellulosic fibers and synthetic fibers, wherein the synthetic fibers have at least one cross-sectional dimension less than about 10 microns and an average fiber length less than about 5.0 mm, the tissue product comprising from about 10 to about 30 percent, by weight of the product, synthetic fibers and the product having a having a GMT greater than about 800 g/3" and a GM Slope from about 5.0 to about 10.0 kg.

In addition to the use of relatively modest amounts of synthetic fiber the tissue products of the present invention are preferably prepared without the addition of binders, particularly latex binders and more specifically carboxyl-functional latex emulsion polymers, such as those described in U.S. Pat. Nos. 6,187,140 and 7,462,258. Latex binders, such as those disclosed in the foregoing references, have been used previously in the manufacture of tissue products to improve wet performance. These binders, however, add manufacturing complexity and cost. Therefore, it is desirable to produce a tissue product, such as the inventive tissues, without the use of binders and more especially latex binders.

Further, tissues prepared according to the present disclosure are not treated with a sizing agent, such as alkyl ketene dimer (AKD) or alkenyl succinic anhydride (ASA), either during the tissue manufacturing process or after formation and drying of the tissue web. Rather, the tissue webs are prepared by adding synthetic fibers and in certain embodiments a wet strength resin, to the papermaking furnish prior to formation of the web, to enhance the wet-strength properties of the finished web. Unlike conventional sizing agents, which reduce the adsorption rate of water into the sheet, synthetic fibers and conventional wet-strength resins allow the sheet to adsorb water as intended during the end use but maintain sheet integrity and strength when wetted.

Rather than employ latex binders or sizing agents, the tissue products may comprise a conventional wet-strength resin in addition to synthetic fibers. Useful conventional wet strength resins include diethylenetriamine (DETA), triethylenetetramine (TETA), tetraethylenepentamine (TEPA), epichlorhydrin resin(s), polyamide-epichlorohydrin (RAE), or any combinations thereof, or any resins to be considered in these families of resins. Particularly preferred wet strength resins are polyamide-epichlorohydrin (RAE) resins. Commonly RAE resins are formed by first reacting a polyalkylene polyamine and an aliphatic dicarboxylic acid or dicarboxylic acid derivative. A polyaminoamide made from diethylenetriamine and adipic acid or esters of dicarboxylic acid derivatives is most common. The resulting polyaminoamide is then reacted with epichlorohydrin. Useful RAE resins are sold under the trade name Kymene® (commercially available from Ashland, Inc., Covington, Ky.).

Generally the conventional wet-strength resin is added to the fiber furnish prior to formation of the tissue web. The amount of the wet-strength resin can be less than about 10.0 kg per ton of furnish, more preferably less than about 8.0 kg per ton of furnish and still more preferably less than about 5.0 kg per ton of furnish. Generally the add-on level of wet-strength resin will be from about 1.0 to about 10.0 kg per ton of furnish and more preferably from about 3.0 to about 8.0 kg per ton of furnish and still more preferably from about 3.0 to about 5.0 kg per ton of furnish.

In certain embodiments the use of synthetic fibers, particularly in the manufacture of tissue products having a GMT greater than about 1500 g/3" and CD Wet Tensile greater than about 400 g/3", results in exceptional wet performance, such as a CD Wet/Dry Ratio greater than about 0.40 and more preferably greater than about 0.42, and still more preferably greater than about 0.45. Additionally the absorbent capacity may be greater than about 6.0 g/g and more preferably greater than about 6.5 gig and still more preferably greater than about 7.0 g/g. For example, in one embodiment the present invention provides a wet laid tissue product formed from a fiber furnish consisting essentially of short cellulosic fibers and synthetic fibers, wherein the synthetic fibers have at least one cross-sectional dimension less than about 10 microns and an average fiber length less than about 5.0 mm, the tissue product comprising from about 10 to about 30 percent, by weight of the product, synthetic fibers and the product having a having a GMT greater than about 1500 g/3" a Wet CD Tensile greater than about 400 g/3" and an Absorbent Capacity greater than about 6.0, and more preferably greater than about 6.5 gig and still more preferably greater than about 7.0 g/g.

In still other embodiments the present invention provides a tissue product comprising at least one multi-layered tissue web comprising three layers where synthetic fibers, and more preferably non-fibrillated PET fibers, are selectively disposed in the middle layer and comprise from about 10 to about 30 percent, by weight of the web, the tissue product having a CD Wet/Dry Ratio greater than about 0.40 and an Absorbent Capacity greater than about 6.0.

As noted previously, the instant tissue products have a high degree of absorbent capacity while also having a CD Wet/Dry Ratio. For example, the present products may have an Absorbent Capacity from about 6.0 to about 7.0 g/g and more preferably from about 6.5 to about 7.0 g/g, and a CD Wet/Dry Ratio greater than about 0.40, such as from about 0.40 to about 0.50. Generally the foregoing properties are achieved at basis weights from about 30 to about 60 grams per square meter (gsm) and more preferably from about 35 to about 45 gsm. While having improved absorbent properties, the tissue products prepared according to the present disclosure continue to be strong enough to withstand use by a consumer. For example, inventive tissue products may have a GMT greater than about 1500 g/3", such as from about 1500 to about 3500 g/3", and more preferably from about 1800 to about 2500 g/3".

Not only may synthetic fibers be used to improve a tissue product's wet performance, they may also be incorporated into a product to provide good flexibility and hand feel. For example, in certain embodiments, the present invention provides a wet laid tissue product formed from a fiber furnish consisting essentially of short cellulosic fibers and from about 10 to about 30 percent, by weight of the product, synthetic fibers having at least one cross-sectional dimension less than about 10 microns and an average fiber length less than about 5.0 mm, the tissue product having a having a GMT from about 800 to about 1500 g/3" and a GM Slope less than about 10.0 kg, such as from about 4.0 to about 10.0 kg and more preferably from about 4.0 to about 6.5 kg. The foregoing GM Slopes are generally achieved at relatively modest GMT, such as from about 600 to about 1500 g/3", and more preferably from about 800 to about 1200 g/3". At these GM Slopes and GMT, the tissue products may have a Stiffness Index less than about 8.0, such as from about 4.0 to about 8.0 and more preferably from about 4.0 to about 6.0.

In still other embodiments forming tissue products from a fiber furnish consisting essentially of short cellulosic fibers and synthetic fibers may yield a tissue product having low rigidity (measured as the ratio of MD Slope to CD Slope) and high softness (measured as TS7). For example, the present invention provides a tissue product comprising synthetic fibers and substantially free from long cellulosic fibers, where the tissue product has a ratio of MD Slope to CD Slope greater than about 1.5, more preferably greater than about 1.75 and still more preferably greater than about 2.0, and a TS7 of about 12.0 or less, such as a TS7 from about 8.0 to about 12.0 and more preferably from about 8.0 to about 11.0.

The tissue products of the present disclosure can generally be formed by any of a variety of papermaking processes known in the art. Preferably the tissue web is formed by either conventional wet pressing or by through-air drying and be either creped or uncreped. For example, a papermaking process of the present disclosure can utilize adhesive creping, wet creping, double creping, embossing, wet-pressing, air pressing, through-air drying, creped through-air drying, uncreped through-air drying, as well as other steps in forming the paper web. Some examples of such techniques are disclosed in U.S. Pat. Nos. 5,048,589, 5,399,412, 5,129,988 and 5,494,554, all of which are incorporated herein in a manner consistent with the present disclosure. When forming multi-ply tissue products, the separate plies can be made from the same process or from different processes as desired.

In a particularly preferred embodiment at least one web of the tissue product is formed by an uncreped through-air drying process, such as the process described, for example, in U.S. Pat. Nos. 5,656,132 and 6,017,417, both of which are hereby incorporated by reference herein in a manner consistent with the present disclosure.

In one embodiment the web is formed using a twin wire former having a papermaking headbox that injects or deposits a furnish of an aqueous suspension of papermaking fibers onto a plurality of forming fabrics, such as the outer forming fabric and the inner forming fabric, thereby forming a wet tissue web. The forming process of the present disclosure may be any conventional forming process known in the papermaking industry. Such formation processes include, but are not limited to, Fourdriniers, roof formers such as suction breast roll formers, and gap formers such as twin wire formers and crescent formers.

The wet tissue web forms on the inner forming fabric as the inner forming fabric revolves about a forming roll. The inner forming fabric serves to support and carry the newly-formed wet tissue web downstream in the process as the wet tissue web is partially dewatered to a consistency of about 10 percent based on the dry weight of the fibers. Additional dewatering of the wet tissue web may be carried out by known paper making techniques, such as vacuum suction boxes, while the inner forming fabric supports the wet tissue web. The wet tissue web may be additionally dewatered to a consistency of greater than 20 percent, more specifically between about 20 to about 40 percent, and even more specifically between about 20 to about 30 percent.

The forming fabric can generally be made from any suitable porous material, such as metal wires or polymeric filaments. For instance, some suitable fabrics can include, but are not limited to, Albany 84M and 94M available from Albany International (Albany, N.Y.); Asten 856, 866, 867, 892, 934, 939, 959, or 937; Asten Synweve Design 274, all of which are available from Asten Forming Fabrics, Inc. (Appleton, Wis.); and Voith 2164 available from Voith Fabrics (Appleton, Wis.).

The wet web is then transferred from the forming fabric to a transfer fabric while at a solids consistency of between about 10 to about 35 percent, and particularly, between about 20 to about 30 percent. As used herein, a "transfer fabric" is a fabric that is positioned between the forming section and the drying section of the web manufacturing process.

Transfer to the transfer fabric may be carried out with the assistance of positive and/or negative pressure. For example, in one embodiment, a vacuum shoe can apply negative pressure such that the forming fabric and the transfer fabric simultaneously converge and diverge at the leading edge of the vacuum slot. Typically, the vacuum shoe supplies pressure at levels between about 10 to about 25 inches of mercury. As stated above, the vacuum transfer shoe (negative pressure) can be supplemented or replaced by the use of positive pressure from the opposite side of the web to blow the web onto the next fabric. In some embodiments, other vacuum shoes can also be used to assist in drawing the fibrous web onto the surface of the transfer fabric.

Typically, the transfer fabric travels at a slower speed than the forming fabric to enhance the MD and CD stretch of the web, which generally refers to the stretch of a web in its cross (CD) or machine direction (MD) (expressed as percent elongation at sample failure). For example, the relative speed difference between the two fabrics can be from about 30 to about 70 percent and more preferably from about 40 to about 60 percent. This is commonly referred to as "rush transfer". During rush transfer many of the bonds of the web are believed to be broken, thereby forcing the sheet to bend and fold into the depressions on the surface of the transfer fabric. Such molding to the contours of the surface of the transfer fabric may increase the MD and CD stretch of the web. Rush transfer from one fabric to another can follow the principles taught in any one of the following patents, U.S. Pat. Nos. 5,667,636, 5,830,321, 4,440,597, 4,551,199, 4,849,054, all of which are hereby incorporated by reference herein in a manner consistent with the present disclosure.

The wet tissue web is then transferred from the transfer fabric to a through-air drying fabric. Typically, the transfer fabric travels at approximately the same speed as the through-air drying fabric. However, a second rush transfer may be performed as the web is transferred from the transfer fabric to the through-air drying fabric. This rush transfer is referred to as occurring at the second position and is achieved by operating the through-air drying fabric at a slower speed than the transfer fabric.

In addition to rush transferring the wet tissue web from the transfer fabric to the through-air drying fabric, the wet tissue web may be macroscopically rearranged to conform to the surface of the through-air drying fabric with the aid of a vacuum transfer roll or a vacuum transfer shoe. If desired, the through-air drying fabric can be run at a speed slower than the speed of the transfer fabric to further enhance MD stretch of the resulting absorbent tissue product. The transfer may be carried out with vacuum assistance to ensure conformation of the wet tissue web to the topography of the through-air drying fabric.

While supported by a through-air drying fabric, the wet tissue web is dried to a final consistency of about 94 percent or greater by a through-air dryer. The web then passes through the winding nip between the reel drum and the reel and is wound into a roll of tissue for subsequent converting.

TEST METHODS

Wet and Dry Tensile

Samples for tensile strength testing are prepared by cutting a 3 inches (76.2 mm) by 5 inches (127 mm) long strip in either the machine direction (MD) or cross-machine direction (CD) orientation using a JDC Precision Sample Cutter (Thwing-Albert Instrument Company, Philadelphia, Pa., Model No. JDC 3-10, Ser. No. 37333). The instrument used for measuring tensile strengths is an MTS Systems Sintech 11S, Serial No. 6233. The data acquisition software is MTS TestWorks™ for Windows Ver. 4 (MTS Systems Corp., Research Triangle Park, N.C.). The load cell is selected from either a 50 Newton or 100 Newton maximum, depending on the strength of the sample being tested, such that the majority of peak load values fall between 10 and 90 percent of the load cell's full scale value. The gauge length between jaws is 4±0.04 inches. The jaws are operated using pneumatic-action and are rubber coated. The minimum grip face width is 3 inches (76.2 mm), and the approximate height of a jaw is 0.5 inches (12.7 mm). The crosshead speed is 10±0.4 inches/min (254±1 mm/min), and the break sensitivity is set at 65 percent. The sample is placed in the jaws of the instrument, centered both vertically and horizontally. The test is then started and ends when the specimen breaks. The peak load is recorded as either the "MD tensile strength" or the "CD tensile strength" of the specimen depending on the sample being tested. At least six (6) representative specimens are tested for each product, taken "as is," and the arithmetic average of all individual specimen tests is either the MD or CD tensile strength for the product.

Wet tensile strength measurements are measured in the same manner, but after the center portion of the previously conditioned sample strip has been saturated with distilled water immediately prior to loading the specimen into the tensile test equipment. More specifically, prior to performing a wet CD tensile test, the sample must be aged to ensure the wet strength resin has cured. Two types of aging were practiced: natural and artificial. Natural aging was used for older samples that had already aged. Artificial aging was used for samples that were to be tested immediately after or within days of manufacture. For natural aging, the samples were held at 73° F., 50 percent relative humidity for a period of 12 days prior to testing. Following this natural aging step, the strips are then wetted individually and tested. For artificially aged samples, the 3-inch wide sample strips were heated for 4 minutes at 105±2° C. Following this artificial aging step, the strips are then wetted individually and tested. Sample wetting is performed by first laying a single test strip onto a piece of blotter paper (Fiber Mark, Reliance Basis 120). A pad is then used to wet the sample strip prior to testing. The pad is a green, Scotch-Brite brand (3M) general purpose commercial scrubbing pad. To prepare the pad for testing, a full-size pad is cut approximately 2.5 inches long by 4 inches wide. A piece of masking tape is wrapped around one of the 4-inch long edges. The taped side then becomes the "top" edge of the wetting pad. To wet a tensile strip, the tester holds the top edge of the pad and dips the bottom edge in approximately 0.25 inches of distilled water located in a wetting pan. After the end of the pad has been saturated with water, the pad is then taken from the wetting pan and the excess water is removed from the pad by lightly tapping the wet edge three times across a wire mesh screen. The wet edge of the pad is then gently placed across the sample, parallel to the width of the sample, in the approximate center of the sample strip. The pad is held in place for approximately one second and then removed and placed back into the wetting pan. The wet sample is then immediately inserted into the tensile grips so the wetted area is approximately centered between the upper and lower grips. The test strip should be centered both horizontally and vertically between the grips. (It should be noted that if any of the wetted portion comes into contact with the grip faces, the specimen must be discarded and the jaws dried off before resuming testing.) The tensile test is then performed and the peak load recorded as the CD wet tensile strength of this specimen. As with the dry CD tensile test, the characterization of a product is determined by the average of at least six, but in the case of the examples disclosed, twenty representative sample measurements.

Absorbency

As used herein, "vertical absorbent capacity" is a measure of the amount of water absorbed by a paper product (single-ply or multi-ply) or a sheet, expressed as grams of water absorbed per gram of fiber (dry weight). In particular, the vertical absorbent capacity is determined by cutting a sheet of the product to be tested (which may contain one or more plies) into a square measuring 100 millimeters by 100 millimeters (±1 mm). The resulting test specimen is weighed to the nearest 0.01 gram and the value is recorded as the "dry weight." The specimen is attached to a 3-point clamping device and hung from one corner in a 3-point clamping device such that the opposite corner is lower than the rest of the specimen, then the sample and the clamp are placed into a dish of water and soaked in the water for 3 minutes (±5 seconds). The water should be distilled or de-ionized water at a temperature of 23±3° C. At the end of the soaking time, the specimen and the clamp are removed from the water. The clamping device should be such that the clamp area and pressure have minimal effect on the test result. Specifically, the clamp area should be only large enough to hold the sample and the pressure should also just be sufficient for holding the sample, while minimizing the amount of water removed from the sample during clamping. The sample specimen is allowed to drain for 3 minutes (±5 seconds). At the end of the draining time, the specimen is removed by holding a weighing dish under the specimen and releasing it from the clamping device. The wet specimen is then weighed to the nearest 0.01 gram and the value recorded as the "wet weight". The vertical absorbent capacity in grams per gram=[(wet weight dry weight)/dry weight]. At least five (5) replicate measurements are made on representative samples from the same, roll or box of product to yield an average vertical absorbent capacity value.

Tissue Softness

Tissue softness was measured using an EMTEC Tissue Softness Analyzer ("TSA") (Emtec Electronic GmbH, Leipzig, Germany). The TSA comprises a rotor with vertical blades which rotate on the test piece applying a defined contact pressure. Contact between the vertical blades and the test piece creates vibrations, which are sensed by a vibration sensor. The sensor then transmits a signal to a PC for processing and display. The signal is displayed as a frequency spectrum. For measurement of TS7 values the blades are pressed against the sample with a load of 100 mN and the rotational speed of the blades is 2 revolutions per second.

The frequency analysis in the range of approximately 200 to 1000 Hz represents the surface smoothness or texture of the test piece. A high amplitude peak correlates to a rougher surface. A further peak in the frequency range between 6 and 7 kHz represents the softness of the test piece. The peak in the frequency range between 6 and 7 kHz is herein referred to as the TS7 Softness Value and is expressed as dB V2 rms. The lower the amplitude of the peak occurring between 6 and 7 kHz, the softer the test piece.

Test samples were prepared by cutting a circular sample having a diameter of 112.8 mm. All samples were allowed to equilibrate at TAPPI standard temperature and humidity conditions for at least 24 hours prior to completing the TSA testing. Only one ply of tissue is tested. Multi-ply samples are separated into individual plies for testing. The sample is placed in the TSA with the softer (dryer or Yankee) side of the sample facing upward. The sample is secured and the measurements are started via the PC. The PC records, processes and stores all of the data according to standard TSA protocol. The reported values are the average of five replicates, each one with a new sample.

Sheet Bulk

Sheet Bulk is calculated as the quotient of the dry sheet caliper (μm) divided by the basis weight (gsm). Dry sheet caliper is the measurement of the thickness of a single tissue sheet measured in accordance with TAPPI test methods T402 and T411 om-89. The micrometer used for carrying out T411 om-89 is an Emveco 200-A Tissue Caliper Tester (Emveco, Inc., Newberg, Oreg.). The micrometer has a load of 2 kilo-Pascals, a pressure foot area of 2500 square millimeters, a pressure foot diameter of 56.42 millimeters, a dwell time of 3 seconds and a lowering rate of 0.8 millimeters per second.

EXAMPLES

Example 1: UCTAD Bath and Towel Products

Base sheets were made using a through-air dried papermaking process commonly referred to as "uncreped through-air dried" ("UCTAD") and generally described in U.S. Pat. No. 5,607,551, the contents of which are incorporated herein in a manner consistent with the present invention. Inventive base sheets were produced from a furnish comprising northern softwood kraft (NSWK), eucalyptus hardwood kraft (EHWK) and synthetic fibers using a layered headbox fed by three stock chests such that the webs having three layers (two outer layers and a middle layer) were formed. Three different types of synthetic fibers were evaluated:

TABLE 1

| Synthetic Fiber Type | Polymer Type | Cross-section Shape | Tradename | Minimum Fiber Dimension (μm) | Fiber Length (mm) |
|---|---|---|---|---|---|
| 2.5/R | PET | Round | Cyphrex ™ 10001 | 2.5 | 1.5 |
| 4.5/R | PET | Round | Cyphrex ™ 10002 | 4.5 | 1.5 |
| 2.5/F | Polyester | Flat | Cyphrex ™ 10101 | 2.5 | 1.5 |

Bath Tissue

Rolled bath tissue products were formed from a three layer web having a target basis weight of about 36 gsm. The layer splits, by weight of the web, are detailed in Table 2, below.

TABLE 2

| Code | First Outer Layer (wt %) | Middle Layer (wt %) | Second Outer Layer (wt %) | NBSK Middle Layer (wt %) | Synthetic Fiber Middle Layer (wt %) | EHWK Middle Layer (wt %) | Synthetic Fiber Type | Refining (min/Fiber) | Starch (kg/MT) |
|---|---|---|---|---|---|---|---|---|---|
| 1 | 30 | 40 | 30 | 12 | 28 | 0 | 4.5/R | 10/EHWK | — |
| 2 | 35 | 30 | 35 | 9 | 21 | 0 | 4.5/R | 10/EHWK | — |
| 3 | 35 | 30 | 35 | 9 | 21 | 0 | 4.5/R | — | — |
| 4 | 30 | 40 | 30 | 20 | 20 | 0 | 2.5/F | 8/EHWK | — |
| 5 | 30 | 40 | 30 | 20 | 20 | 0 | 2.5/F | 8/EHWK | 3 |
| 6 | 30 | 40 | 30 | 20 | 20 | 0 | Flat | 8/EHWK | 6 |
| 7 | 30 | 40 | 30 | 0 | 10 | 30 | 2.5/R | 6/EHWK | — |
| 8 | 30 | 40 | 30 | 0 | 10 | 30 | 2.5/R | 6/EHWK | 3 |
| 9 | 30 | 40 | 30 | 0 | 10 | 30 | 2.5/R | 6/EHWK | 6 |
| Control 1 | 30 | 40 | 30 | 40 | 0 | 0 | — | — | — |
| Control 2 | 30 | 40 | 30 | 40 | 0 | 0 | — | — | 3 |
| Control 3 | 30 | 40 | 30 | 40 | 0 | 0 | — | — | 6 |
| Control 4 | 30 | 40 | 30 | 40 | 0 | 0 | — | — | — |
| Control 5 | 30 | 40 | 30 | 40 | 0 | 0 | — | — | 3 |
| Control 6 | 30 | 40 | 30 | 40 | 0 | 0 | — | — | 6 |
| Control 7 | 30 | 40 | 30 | 40 | 0 | 0 | — | — | 12 |
| Control 8 | 30 | 40 | 30 | 40 | 0 | 0 | — | — | 15 |

The tissue web was formed on a Voith Fabrics TissueForm V forming fabric, vacuum dewatered to approximately 25 percent consistency and then subjected to rush transfer when transferred to the transfer fabric. The layer splits, by weight of the web, are detailed in Table 2, above. The transfer fabric was the fabric described as t1207-11 (commercially available from Voith Fabrics, Appleton, Wis.). The web was then transferred to a through-air drying fabric. Transfer to the through-drying fabric was done using vacuum levels of greater than 10 inches of mercury at the transfer. The web was then dried to approximately 98 percent solids before winding.

The base sheet webs were converted into rolled bath products by calendering using a conventional polyurethane/steel calender comprising a 4 P&J polyurethane roll on the air side of the sheet and a standard steel roll on the fabric side. The finished product comprised a single ply of base sheet. The finished products were subjected to physical testing, the results of which are summarized in Table 3, below.

TABLE 3

| Code | Basis Weight (gsm) | Caliper (microns) | Sheet Bulk (cc/g) | GMT (g/3") | GM TEA | GM Slope (kg) | Stiffness Index | Slope MD:CD |
|---|---|---|---|---|---|---|---|---|
| 1 | 35.1 | 427.0 | 12.17 | 965 | 8.7 | 6.84 | 7.08 | 1.88 |
| 2 | 35.5 | 415.8 | 11.70 | 1128 | 10.5 | 7.20 | 6.38 | 1.93 |
| 3 | 29.8 | 411.2 | 13.79 | 910 | 8.4 | 6.01 | 6.61 | 2.10 |
| 4 | 36.4 | 421.9 | 11.61 | 718 | 6.8 | 5.61 | 7.81 | 1.95 |
| 5 | 36.5 | 404.6 | 11.07 | 797 | 7.6 | 5.82 | 7.31 | 2.22 |
| 6 | 36.9 | 401.3 | 10.87 | 926 | 9.2 | 6.37 | 6.88 | 2.31 |
| 7 | 36.9 | 463.8 | 12.57 | 1396 | 16.3 | 8.20 | 5.87 | 1.47 |
| 8 | 36.5 | 455.7 | 12.48 | 1677 | 21.2 | 9.44 | 5.63 | 1.51 |
| 9 | 37.0 | 478.8 | 12.94 | 1848 | 23.4 | 9.75 | 5.27 | 1.38 |
| Control 1 | 37.0 | 399.8 | 10.79 | 765 | 7.0 | 6.28 | 8.21 | 1.24 |
| Control 2 | 36.9 | 450.1 | 12.20 | 1063 | 10.9 | 7.59 | 7.14 | 1.39 |
| Control 3 | 36.7 | 456.2 | 12.42 | 1214 | 12.7 | 8.33 | 6.86 | 1.31 |
| Control 4 | 36.6 | 406.9 | 11.11 | 699 | 7.1 | 6.02 | 8.62 | 1.22 |
| Control 5 | 36.7 | 406.7 | 11.09 | 1015 | 10.5 | 8.60 | 8.47 | 1.12 |
| Control 6 | 36.3 | 428.5 | 11.81 | 1190 | 12.8 | 8.99 | 7.56 | 1.14 |
| Control 7 | 36.5 | 390.4 | 10.70 | 955 | 9.8 | 7.50 | 7.86 | 1.76 |
| Control 8 | 36.2 | 402.6 | 11.13 | 1088 | 11.5 | 8.01 | 7.36 | 1.97 |

The softness of certain samples was further evaluated using a Tissue Softness Analyzer, the results of which are reproduced in Table 4, below.

TABLE 4

| Code | Basis Weight (gsm) | GMT (g/3") | TS7 |
|---|---|---|---|
| 1 | 35.1 | 965 | 9.6 |
| 2 | 35.5 | 1128 | 11.4 |
| 3 | 29.8 | 910 | 12.1 |
| 4 | 36.4 | 718 | 12.1 |
| 5 | 36.5 | 797 | 12.0 |
| 6 | 36.9 | 926 | 11.9 |
| Control 1 | 37.0 | 765 | 10.5 |
| Control 2 | 36.9 | 1063 | 13.7 |
| Control 3 | 36.7 | 1214 | 15.1 |

Towels

Rolled tissue towel products were formed from a three layer web having a target basis weight of about 36 gsm. The layer splits, by weight of the web, are detailed in Table 5, below.

TABLE 5

| Code | First Outer Layer (wt %) | Middle Layer (wt %) | Second Outer Layer (wt %) | NBSK Middle Layer (wt %) | Synthetic Fiber Middle Layer (wt %) | EHWK Middle Layer (wt %) | Synthetic Fiber Type | Refining (min/Fiber) |
|---|---|---|---|---|---|---|---|---|
| 7 | 30 | 40 | 30 | 0 | 12 | 28 | 2.5 | 8/EHWK |
| 8 | 30 | 40 | 30 | 0 | 12 | 28 | flat | 6/EHWK |
| 9 | 30 | 40 | 30 | 0 | 12 | 28 | 4.5 | 6/EHWK |
| Control 9 | 30 | 40 | 30 | 40 | 0 | 0 | — | 2/NSWK |
| Control 10 | 30 | 40 | 30 | 40 | 0 | 0 | — | 4/NSWK |
| Control 11 | 30 | 40 | 30 | 40 | 0 | 0 | — | 6/NSWK |

The tissue web was formed on a Voith Fabrics TissueForm V forming fabric, vacuum dewatered to approximately 25 percent consistency and then subjected to rush transfer when transferred to the transfer fabric. The layer splits, by weight of the web, are detailed in Table 5, above. The transfer fabric was the fabric described as t1207-11 (commercially available from Voith Fabrics, Appleton, Wis.). The web was then transferred to a through-air drying fabric. Transfer to the through-drying fabric was done using vacuum levels of greater than 10 inches of mercury at the transfer. The web was then dried to approximately 98 percent solids before winding.

The base sheet webs were converted into rolled towel products by calendering using a conventional polyurethane/steel calender comprising a 4 P&J polyurethane roll on the air side of the sheet and a standard steel roll on the fabric side. The finished product comprised a single ply of base sheet. The finished products were subjected to physical testing, the results of which are summarized in Table 6, below.

TABLE 6

| Code | Basis Weight (gsm) | Specific Absorbent Capacity (g/g) | CD Wet/Dry Ratio | GMT (g/3") | GM TEA | GM Slope (kg) | CD Dry Tensile (g/3") | CD Wet Tensile (g/3") |
|---|---|---|---|---|---|---|---|---|
| 7 | 37.3 | 8.13 | 0.45 | 1447 | 15.9 | 6.34 | 1116 | 497 |
| 8 | 36.2 | 8.13 | 0.42 | 1097 | 9.6 | 5.76 | 777 | 327 |
| 9 | 36.4 | 8.53 | 0.52 | 1063 | 9.1 | 6.26 | 829 | 430 |
| Control 9 | 34.5 | 6.76 | 0.32 | 1823 | 18.4 | 6.22 | 1317 | 427 |
| Control 10 | 34.7 | 6.43 | 0.28 | 2181 | 22.4 | 8.02 | 1589 | 437 |
| Control 11 | 34.6 | 6.00 | 0.32 | 2775 | 29.8 | 8.56 | 1998 | 632 |

Example 2: Wet Pressed Creped Facial Tissue

Creped wet pressed tissue webs having a target basis weight of about 16 gsm were produced using a conventional wet pressed tissue-making process. Each web was formed using a multi-layered headbox providing a web with two outer layers and middle layer. The webs had the following composition:

TABLE 7

| Code | First Outer Layer (wt %) | Middle Layer (wt %) | Second Outer Layer (wt %) | Synthetic Fiber Type | Refining (min/Fiber) | Starch (kg/MT) |
|---|---|---|---|---|---|---|
| 10 | EHWK 35% | NSWK 30% | EHWK 35% | — | 2/NSWK | — |
| 11 | EHWK 35% | NSWK 30% | EHWK 35% | — | 2/NSWK | 3 |
| 12 | EHWK 35% | NSWK 30% | EHWK 35% | — | 2/NSWK | 6 |
| Control 12 | EHWK 35% | Syn. 30% | EHWK 35% | 2.5/R | 4/EHWK | — |
| Control 13 | EHWK 35% | Syn. 30% | EHWK 35% | 2.5/R | 4/EHWK | 3 |
| Control 14 | EHWK 35% | Syn. 30% | EHWK 35% | 2.5/R | 4/EHWK | 6 |

The wet sheet, about 10 to 20 percent consistency, was adhered to a Yankee dryer through a nip via a pressure roll. The consistency of the wet sheet after the pressure roll nip (post-pressure roll consistency or PPRC) was approximately 40 percent. The wet sheet is adhered to the Yankee dryer due to the creping composition that is applied to the dryer surface. A spray boom situated underneath the Yankee dryer sprayed the creping composition onto the dryer surface. The creping compositions generally comprised a mixture of Crepetrol™ A2320 (adhesive agent) and Rezosol™ 4119 (release agent) (Ashland Water Technologies, Wilmington, Del.). Creping compositions were prepared by dissolution of the solid polymers into water followed by stirring until the solution was homogeneous.

The sheet was dried to about 98 to 99 percent consistency as it traveled on the Yankee dryer and to the creping blade. The creping blade subsequently scraped the tissue sheet and a portion of the creping composition off the Yankee dryer. The creped tissue basesheet was then wound onto a core traveling at about 1575 fpm (480 mpm) into soft rolls for converting.

Two tissue webs were plied together and calendered with two steel rolls at 20 pounds per lineal inch. The 2-ply product had the dryer/softener layer plied to the outside. The resulting tissue products were subject to physical testing as described above, the results of which are summarized in the tables below.

TABLE 8

| Code | Basis Weight (gsm) | Sheet Bulk (cc/g) | GMT (g/3") | GM Slope (kg) | GM TEA | Stiffness Index |
|---|---|---|---|---|---|---|
| Control 12 | 32.4 | 7.87 | 470.7 | 5.2 | 4.4 | 9.35 |
| Control 13 | 31.5 | 6.61 | 834.3 | 11.1 | 6.8 | 8.15 |
| Control 14 | 32.2 | 7.08 | 855.9 | 11.6 | 8.2 | 9.58 |
| 10 | 32.5 | 6.96 | 946.5 | 8.5 | 8.8 | 9.30 |
| 11 | 33.2 | 7.19 | 1217.1 | 10.7 | 11.3 | 9.28 |
| 12 | 32.6 | 7.65 | 1589.2 | 13.3 | 14.6 | 9.19 |

The foregoing represents several examples of inventive tissue products prepared according to the present disclosure. In other embodiments, such as a first embodiment, the present invention provides a tissue product comprising at least one tissue web, the tissue web comprising synthetic fiber having at least one cross-section dimension less than about 20 microns, the tissue product having a geometric mean tensile (GMT) greater than about 800 g/3" and a geometric mean slope (GM Slope) less than about 10.0 kg.

In a second embodiment the present invention provides the tissue product of the first embodiment wherein the tissue web is substantially free from cellulosic fibers having an average fiber length greater than about 2.0 mm.

In a third embodiment the present invention provides the tissue product of the first or second embodiments wherein the tissue web comprises from about 10 to about 30 percent, by weight of the tissue web synthetic fiber.

In a fourth embodiment the present invention provides the tissue product of any one of the first through third embodiments wherein the synthetic fiber has a substantially circular cross section and a diameter from about 0.5 to about 10 microns.

In a fifth embodiment the present invention provides the tissue product of any one of the first through fourth embodiments wherein the synthetic fiber has a substantially rectangular cross section with a width dimension that is greater than the height dimension and wherein the height dimension is from about 0.5 to about 10 microns.

In a sixth embodiment the present invention provides the tissue product of any one of the first through fifth embodiments having a GMT from about 800 to about 1200 g/3" and a GM Slope from about 5.0 to about 8.0 kg.

In a seventh embodiment the present invention provides the tissue product of any one of the first through sixth embodiments having a GMT from about 800 to about 1200 g/3" and a Stiffness Index from about 4.0 to about 6.0.

In an eighth embodiment the present invention provides the tissue product of any one of the first through seventh embodiments wherein the product is substantially free from latex binder and has an Absorbent Capacity greater than about 6.0 g/g and a CD Wet/Dry Ratio greater than about 0.40.

In an ninth embodiment the present invention provides the tissue product of any one of the first through eighth embodiments having an Absorbent Capacity from about 6.5 to about 7.0 g/g and a CD Wet/Dry Ratio from about 0.42 to about 0.50.

In a tenth embodiment the present invention provides the tissue product of any one of the first through ninth embodiments wherein the tissue product comprises a single-ply multi-layered web having a first and second outer layer and middle layer disposed there between.

In a eleventh embodiment the present invention provides the tissue product of any one of the first through tenth embodiments wherein the synthetic fiber is selectively disposed in the middle layer and comprises from about 10 to about 30 percent of the weight of the tissue web.

In a twelfth embodiment the present invention provides a tissue product comprising at least one wet laid multi-layered tissue web comprising a fiber furnish consisting essentially of synthetic fibers and short cellulosic fibers, the multi-layered tissue web having a first and second outer layer and a middle layer disposed there between where the synthetic fibers are selectively disposed in the middle layer and the first and second layers are substantially free from synthetic fibers, the tissue product having a geometric mean tensile (GMT) greater than about 800 g/3" and a geometric mean slope (GM Slope) less than about 10.0 kg.

In a thirteenth embodiment the present invention provides the tissue product of the twelfth embodiment wherein the synthetic fiber is non-fibrillated and has at least one cross-section dimension less than about 20 microns and an average fiber length from about 1.0 to about 5.0 mm.

In a fourteenth embodiment the present invention provides the tissue product of the twelfth or thirteenth embodiments wherein the tissue web comprises from about 10 to about 30 percent, by weight of the tissue web, synthetic fiber.

In a fifteenth embodiment the present invention provides the tissue product of any one of the twelfth through fourteenth embodiments wherein the synthetic fiber has a substantially circular cross section and a diameter from about 0.5 to about 10 microns.

In a sixteenth embodiment the present invention provides the tissue product of any one of the twelfth through fifteenth embodiments the tissue product having a GMT from about 800 to about 1,200 g/3" and a GM Slope from about 5.0 to about 8.0 kg and a Stiffness Index from about 4.0 to about 6.0.

In a seventeenth embodiment the present invention provides the tissue product of any one of the twelfth through sixteenth embodiments wherein the product is substantially free from latex binder and has an Absorbent Capacity greater than about 6.0 g/g and a CD Wet/Dry Ratio greater than about 0.40.

In an eighteenth embodiment the present invention provides a tissue product comprising at least two conventional wet pressed, creped, tissue webs, the webs comprising a first and second outer layer and a middle layer disposed there between, and a fiber furnish consisting essentially of synthetic fibers and short cellulosic fibers, where the synthetic fibers are selectively disposed in the middle layer and the first and second layers are substantially free from synthetic fibers, the tissue product having a geometric mean tensile (GMT) greater than about 800 g/3" and a geometric mean slope (GM Slope) less than about 15.0 kg.

In a nineteenth embodiment the present invention provides the tissue product of the eighteenth embodiment wherein the synthetic fiber is non-fibrillated and has at least one cross-section dimension less than about 20 microns and an average fiber length from about 1.0 to about 5.0 mm.

In a twentieth embodiment the present invention provides the tissue product of eighteenth or the nineteenth embodiments wherein the tissue web comprises from about 10 to about 30 percent, by weight of the tissue web, synthetic fiber.

In a twenty-first embodiment the present invention provides the tissue product of any one of the eighteenth through the twentieth embodiments wherein the product has a GMT from about 800 to about 1,200 g/3" and a GM Slope from about 6.0 to about 12.0.

In a twenty-second embodiment the present invention provides the tissue product of any one of the eighteenth through the twenty-first embodiments wherein the product has a sheet bulk greater than about 7.0 cc/g and a basis weight greater than about 30 gsm.

In a twenty-third embodiment the present invention provides a tissue product comprising at least one through-air dried multi-layered tissue web comprising a fiber furnish consisting essentially of synthetic fibers and short cellulosic fibers, the multi-layered tissue web having a first and second outer layer and a middle layer disposed there between where the synthetic fibers are selectively disposed in the middle layer and the first and second layers are substantially free from synthetic fibers, the tissue product having a geometric mean tensile (GMT) greater than about 800 g/3" and a geometric mean slope (GM Slope) less than about 10.0 kg having a TS7 less than about 12 and more preferably less than about 10, such as from about 8 to about 12.

What is claimed is:

1. A tissue product comprising at least one tissue web, the tissue web comprising from about 10 to about 30 wt % non-fibrillated synthetic fiber having at least one cross-section dimension less than 20 microns and an average fiber length from about 1.0 to about 5.0 mm, the tissue product having a geometric mean tensile (GMT) greater than about 800 g/3" and a geometric mean slope (GM Slope) less than about 10.0 kg and wherein the tissue web is substantially free from cellulosic fibers having an average fiber length greater than about 2.0 mm.

2. The tissue product of claim 1 wherein the non-fibrillated synthetic fiber has a substantially circular cross section and a diameter from about 0.5 to about 10 microns.

3. The tissue product of claim 1 wherein the non-fibrillated synthetic fiber has a substantially rectangular cross section with a width dimension that is greater than the height dimension and wherein the height dimension is from about 0.5 to about 10 microns.

4. The tissue product of claim 3 wherein the non-fibrillated synthetic fiber has a substantially rectangular cross section and a width dimension less than about 25 microns.

5. The tissue product of claim 1 having a GMT from about 800 to about 1200 g/3" and a GM Slope from about 5.0 to about 8.0 kg.

6. The tissue product of claim 1 having a GMT from about 800 to about 1200 g/3" and a Stiffness Index from about 4.0 to about 6.0.

7. The tissue product of claim 1, wherein the product is substantially free from latex binder and has an Absorbent Capacity greater than about 6.0 g/g and a CD Wet/Dry tensile ratio greater than about 0.40.

8. The tissue product of claim 1 having an Absorbent Capacity from about 6.5 to about 7.0 g/g and a CD Wet/Dry tensile ratio from about 0.42 to about 0.50.

9. The tissue product of claim 1 wherein the tissue product comprises at least one multi-layered web having a first and second outer layer and a middle layer disposed there between and wherein the non-fibrillated synthetic fiber is selectively disposed in the middle layer and comprises from about 10 to about 30 percent of the weight of the tissue web.

10. A tissue product comprising at least one wet laid multi-layered tissue web comprising a fiber furnish consisting essentially of non-fibrillated synthetic fibers having an average fiber length from about 1.0 to about 5.0 mm and cellulosic fibers having an average fiber length from about 0.5 to about 2.0 mm, the multi-layered tissue web having a first and second outer layer and a middle layer disposed there between wherein the non-fibrillated synthetic fibers are selectively disposed in the middle layer and the first and second layers are substantially free from non-fibrillated synthetic fibers, the tissue product having a GMT greater than about 800 g/3" and a GM Slope less than about 10.0 kg and wherein the tissue web comprises from about 10 to about 30 percent, by weight of the tissue web, of the non-fibrillated synthetic fiber.

11. The tissue product of claim 10 wherein the non-fibrillated synthetic fiber has at least one cross-section dimension less than about 20 microns and an average fiber length from about 1.0 to about 5.0 mm.

12. The tissue product of claim 10 wherein the non-fibrillated synthetic fiber has a substantially circular cross section and a diameter from about 0.5 to about 10 microns.

13. The tissue product of claim 10 having a GMT from about 800 to about 1200 g/3" and a GM Slope from about 5.0 to about 8.0 kg.

14. The tissue product of claim 10 having a GMT from about 800 to about 1200 g/3" and a Stiffness Index from about 4.0 to about 6.0.

15. A method of forming a wet laid tissue web comprising the steps of:

a. providing a first fiber furnish consisting essentially of cellulosic fibers having an average fiber length from about 0.5 to about 2.0 mm;

b. providing a second fiber furnish consisting essentially of non-fibrillated synthetic fibers having at least one cross-section dimension less than 20 microns and an average fiber length from about 1.0 to about 5.0 mm and cellulosic fibers having an average fiber length from about 0.5 to about 2.0 mm;

c. depositing the first and second fiber furnish on a forming fabric to form a wet tissue web;

d. partially dewatering the wet tissue web; and e. drying the tissue web, wherein the web comprises from about 10 to about 30 wt % non-fibrillated synthetic fibers and has a GMT greater than about 800 g/3" and a GM Slope less than about 15.0 kg.

16. The method of claim 15 further comprising the steps of (f) creping the tissue web and (g) plying two webs together to form a tissue product, wherein the tissue product has a GMT greater from about 800 to about 1,200 g/3" and a GM Slope from about 6.0 to about 12.0 kg.

17. The method of claim 15 wherein the non-fibrillated synthetic fiber is a non-fibrillated polyethylene terephthalate (PET) fiber having a substantially circular cross section and a diameter from about 0.5 to about 10 microns.

* * * * *